US010464190B2

(12) United States Patent
Wang et al.

(10) Patent No.: US 10,464,190 B2
(45) Date of Patent: Nov. 5, 2019

(54) SUBSTRATE, EDGE POLISHING DETECTION METHOD AND DEVICE AND POSITIONING METHOD AND DEVICE FOR THE SAME, EXPOSURE APPARATUS AND EVAPORATION DEVICE

(71) Applicants: BOE TECHNOLOGY GROUP CO., LTD., Beijing (CN); ORDOS YUANSHENG OPTOELECTRONICS CO., LTD., Inner Mongolia Autonomous Region (CN)

(72) Inventors: Qiang Wang, Beijing (CN); Libin Liu, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 0 days.

(21) Appl. No.: 15/545,074

(22) PCT Filed: Feb. 16, 2017

(86) PCT No.: PCT/CN2017/073758
§ 371 (c)(1),
(2) Date: Jul. 20, 2017

(87) PCT Pub. No.: WO2017/197936
PCT Pub. Date: Nov. 23, 2017

(65) Prior Publication Data

US 2019/0061100 A1 Feb. 28, 2019

(30) Foreign Application Priority Data

May 20, 2016 (CN) ..... 2016 1 0342023

(51) Int. Cl.
*B24B 49/10* (2006.01)
*B24B 49/04* (2006.01)
(Continued)

(52) U.S. Cl.
CPC ..... *B24B 49/04* (2013.01); *B24B 9/10* (2013.01); *B24B 21/02* (2013.01); *B24B 49/10* (2013.01)

(58) Field of Classification Search
CPC ..... B24B 49/10; B24B 49/04; B24B 9/10
(Continued)

(56) References Cited

U.S. PATENT DOCUMENTS 3,425,166 A * 2/1969 Bowser ..... B24C 3/322 451/102
3,691,695 A * 9/1972 Green ..... B24C 3/322 451/2
(Continued)

FOREIGN PATENT DOCUMENTS

CN 1056162 A 11/1991
CN 1447158 A 10/2003
(Continued)

OTHER PUBLICATIONS

First Office Action for Chinese Application No. 201610342023.X, dated Oct. 26, 2017, 7 Pages.
(Continued)

*Primary Examiner* — Robert A Rose
(74) *Attorney, Agent, or Firm* — Brooks Kushman P.C.

(57) ABSTRACT

A substrate, an edge polishing detection method and device and a positioning method and device for the same, an exposure apparatus and an evaporation device are provided. The substrate includes a base substrate and at least one edge polishing detection pattern on the base substrate. The at least
(Continued)

one edge polishing detection pattern is provided at an edge of the base substrate and made of a conductive material.

19 Claims, 12 Drawing Sheets

(51) Int. Cl.
*B24B 9/10* (2006.01)
*B24B 21/02* (2006.01)

(58) Field of Classification Search
USPC ..... 451/5, 8–11, 44, 41
See application file for complete search history.

(56) References Cited

U.S. PATENT DOCUMENTS

| | | | | |
|---|---|---|---|---|
| 4,674,235 | A | 6/1987 | Inoue | |
| 4,878,315 | A * | 11/1989 | Dawson | B23Q 17/22 451/1 |
| 5,081,421 | A | 1/1992 | Miller et al. | |
| 7,681,303 | B2 * | 3/2010 | Kondo | G11B 5/1278 29/603.09 |
| 2003/0190862 | A1 | 10/2003 | Chae et al. | |

FOREIGN PATENT DOCUMENTS

| | | | |
|---|---|---|---|
| CN | 101607376 | A | 12/2009 |
| CN | 102049733 | A | 5/2011 |
| CN | 102101257 | A | 6/2011 |
| CN | 102574260 | A | 7/2012 |
| CN | 203156504 | U | 8/2013 |
| CN | 105364696 | A | 3/2016 |
| CN | 106041667 | A | 10/2016 |
| DE | 3034890 | A1 | 4/1981 |
| JP | S63278868 | A | 11/1988 |
| JP | 2003340697 | A | 12/2003 |

OTHER PUBLICATIONS

International Search Report and Written Opinion for Application No. PCT/CN2017/073758, dated May 15, 2017, 10 Pages.
Second Office Action for Chinese Application No. 281610342823.X, dated Jul. 9, 2018, 7 Pages.

* cited by examiner

SUBSTRATE, EDGE POLISHING DETECTION METHOD AND DEVICE AND POSITIONING METHOD AND DEVICE FOR THE SAME, EXPOSURE APPARATUS AND EVAPORATION DEVICE

CROSS-REFERENCE TO RELATED APPLICATIONS

This application is the U.S. national phase of PCT Application No. PCT/CN2017/073758 filed on Feb. 16, 2017, which claims priority to Chinese Patent Application No. 201610342023.X filed on May 20, 2016, the disclosures of which are incorporated in their entirety by reference herein.

TECHNICAL FIELD

The present disclosure relates to the field of display technology, and in particular to a substrate, an edge polishing detection method and device and a positioning method and device for the same, an exposure apparatus and an evaporation device.

BACKGROUND

When a glass substrate for manufacturing a display device is of a relative large size and does not comply with the size requirements in the subsequent process, it is required to cut the glass substrate first. After the glass substrate is cut, the edge of the cut substrate may have many burrs, and then it is required to polish the edge of the cut substrate, so as to prevent the glass from being damaged in subsequent processes.

In the related art, the edge polishing result of the glass substrate is generally determined by an experienced engineer with the naked eyes, so there may be a large error. As a result, aligning in the subsequent processes may be difficult, the processing equipment may be occupied inefficiently, the processing time may be wasted, and production efficiency may be decreased.

SUMMARY

In view of this, a substrate, an edge polishing detection method and device and a positioning method and device for the same are provided in the present disclosure, so as to eliminate the difficulty in detecting the edge polishing effect of the base substrate of the substrate.

To solve the above technical issue, a substrate is provided in the present disclosure, including a base substrate and at least one edge polishing detection pattern on the base substrate, where the at least one edge polishing detection pattern is provided at an edge of the base substrate and made of a conductive material.

In some embodiments, four edge polishing detection patterns are provided at four edges of the base substrate respectively.

In some embodiments, the edge polishing detection patterns at two opposite edges of the base substrate respectively are identical.

In some embodiments, each edge polishing detection pattern includes a plurality of resistive wires arranged side by side, and the plurality of resistive wires extends in a direction identical to an extension direction of the edge of the base substrate where the plurality of resistive wires is located.

In some embodiments, the plurality of resistive wires is of an identical width.

In some embodiments, every two adjacent resistive wires are spaced at an identical interval.

In some embodiments, two probe contacts are provided at two ends of each edge polishing detection pattern respectively, two ends of each resistive wire of the edge polishing detection pattern are connected to the two probe contacts respectively, and the plurality of resistive wires of the edge polishing detection pattern is connected in parallel via the two probe contacts.

In some embodiments, the resistive wires are made of a doped semiconductor material or a metallic material with a resistivity above a predetermined threshold.

In some embodiments, the doped semiconductor material includes P-type silicon, GaAs, GaN or ZnO.

In some embodiments, each edge polishing detection pattern includes a plurality of resistive blocks and a plurality of connecting wires configured to connect the plurality of resistive blocks in series.

In some embodiments, the plurality of resistive blocks is of an identical size and aligned with each other along an extension direction of the edge of the base substrate where the plurality of resistive blocks is located.

In some embodiments, two probe contacts are provided at two ends of each edge polishing detection pattern respectively, and the two probe contacts are connected to the resistive blocks in series via the connecting wires.

In some embodiments, the edge polishing detection pattern is strip-like, and an extension direction of a longer side of the strip-like conductive pattern is identical to an extension direction of the edge of the base substrate where the strip-like conductive pattern is located.

A substrate edge polishing detection method for the above-mentioned substrate is further provided in the present disclosure, including:

measuring a resistance of each edge polishing detection pattern; and determining, based on the resistance of each edge polishing detection pattern, edge polishing degree data of an edge of the base substrate where the polishing detection pattern is located.

A substrate positioning method is further provided in the present disclosure, including:

acquiring the edge polishing degree data determined by the above edge polishing detection method; and controlling a table carrying the substrate to move based on the edge polishing degree data, to adjust a position of the substrate.

A substrate edge polishing detection device for the above-mentioned substrate is further provided in the present disclosure, including:

a resistance measurement module, configured to measure a resistance of each edge polishing detection pattern; and an edge polishing data determination module, configured to determine, based on the resistance of each edge polishing detection pattern, edge polishing degree data of the edge of the base substrate where the polishing detection pattern is located.

In some embodiments, the resistance measurement module includes:

a probe module including at least two sets of probes, wherein two sets of probes of the at least two sets of probes are configured to be connected to two ends of the edge polishing detection pattern to energize the edge polishing detection pattern; and a microprocessor, configured to acquire a current detection result of the energized edge polishing detection pattern and determine the resistance of the edge polishing detection pattern based on the current detection result.

A substrate positioning device is further provided in the present disclosure, including:

an acquisition module, configured to receive the edge polishing degree data transmitted from the above-mentioned substrate edge polishing detection device; and a controlling module, configured to control a table carrying the substrate to move based on the edge polishing degree data, to adjust a position of the substrate.

An exposure apparatus including the above-mentioned substrate positioning device is further provided in the present disclosure.

An evaporation device including the above-mentioned substrate positioning device is further provided in the present disclosure.

According to the present disclosure, because the edge polishing detection pattern is arranged at the edge of the substrate and made of the conductive material, after the edge of the substrate is polished, it is possible to determine an attrition degree of the edge polishing detection pattern by detecting a resistance of the edge polishing detection pattern, and thereby determining an attrition degree of the substrate. Compared with the detection method in the related art, the above-mentioned detection method is more accurate, the implementation thereof is simple, and the cost thereof is low.

DETAILED DESCRIPTION

In the related art, after the edge of the base substrate of the substrate is polished, it is difficult to detect the edge polishing effect. To solve the above technical issue, a substrate is provided in the present disclosure, including a base substrate and at least one edge polishing detection pattern on the base substrate, where the edge polishing detection pattern is at an edge of the base substrate and made of a conductive material.

Because the edge polishing detection pattern is arranged at the edge of the substrate and made of the conductive material, after the edge of the substrate is polished, it is possible to determine the attrition degree of the edge polishing detection pattern by detecting a resistance of the edge polishing detection pattern, and thereby to determine the attrition degree of the substrate. Compared with the detection method in the related art, the above detection method is more accurate, an implementation thereof is simple, and a cost thereof is low.

Figure 10:
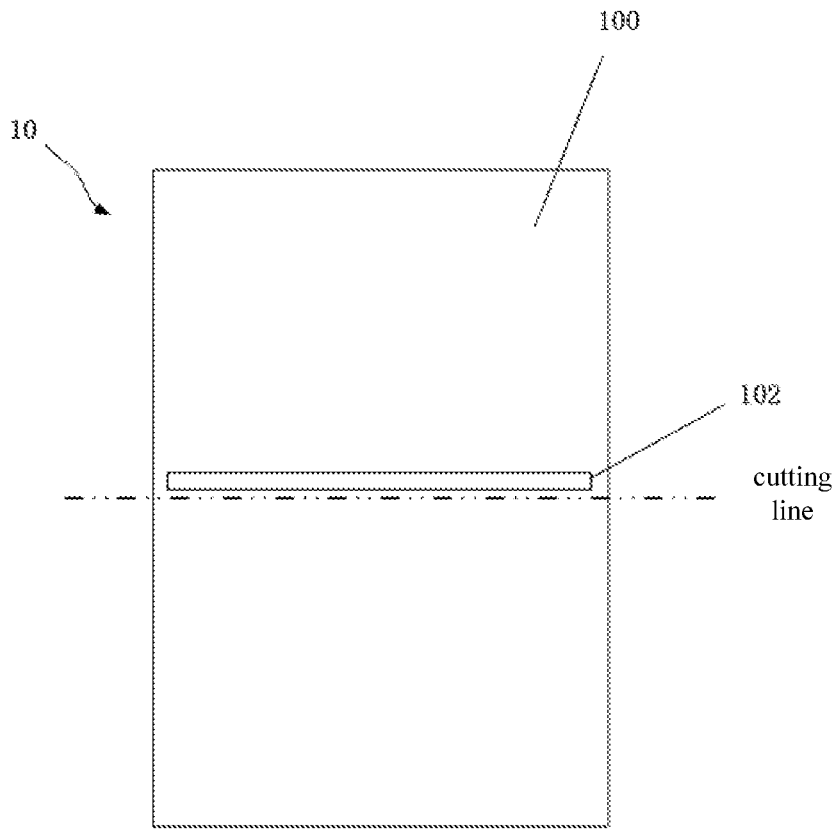
FIGS. 10-12 show the arrangements of different quantity of edge polishing detection patterns in some embodiments of the present disclosure.
Figure 11:
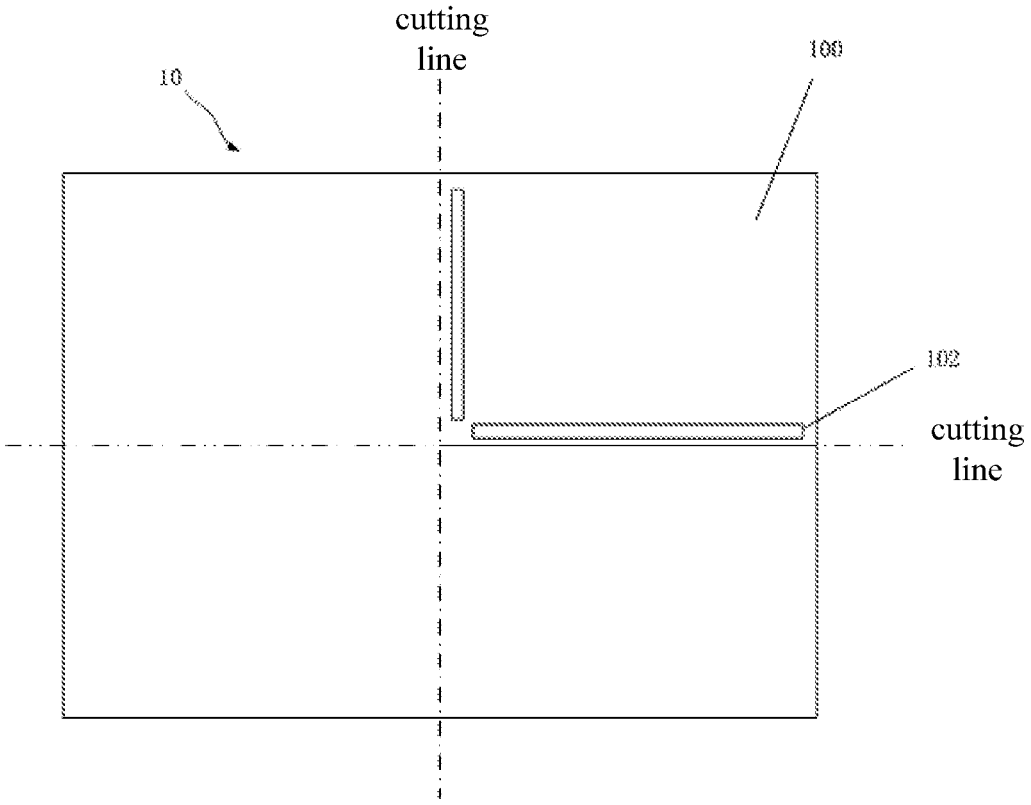
Figure 12:
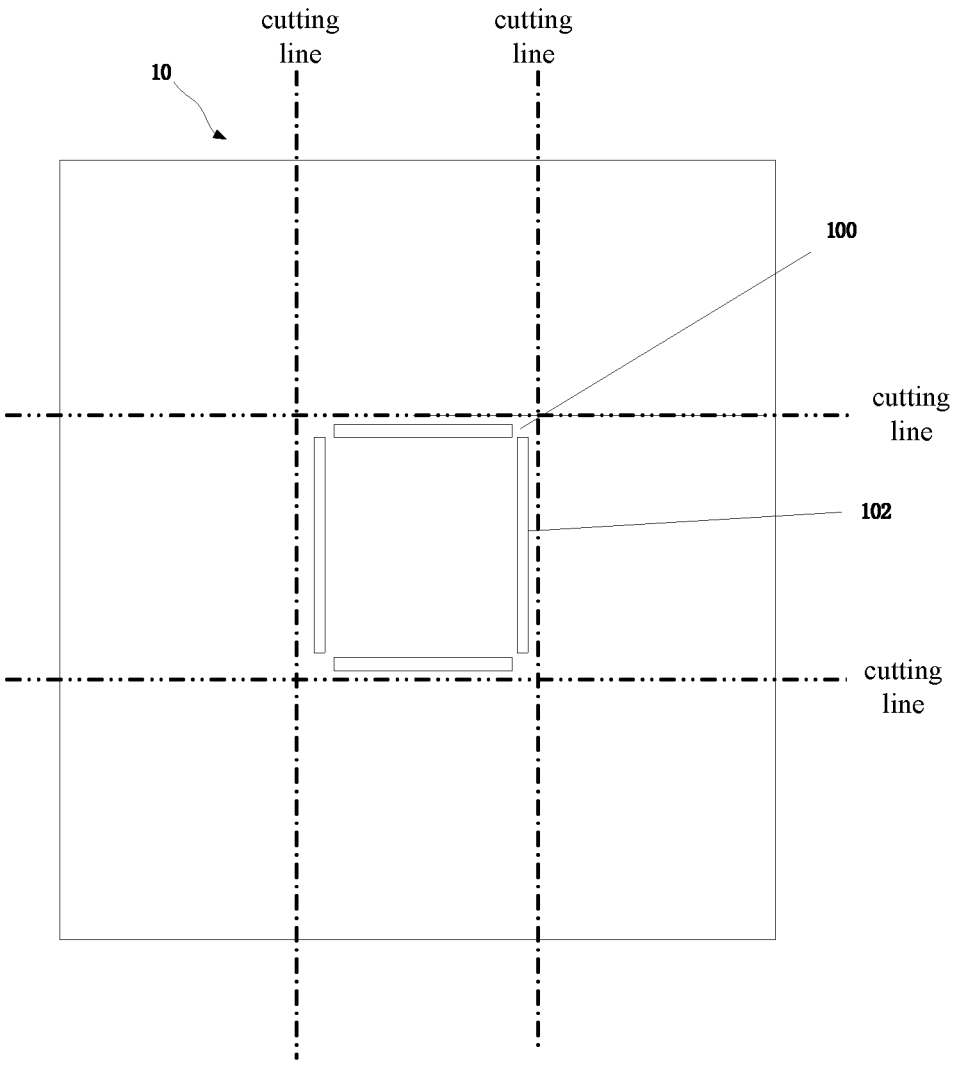

A quantity of the edge polishing detection patterns may be determined based on the practical requirements. For example, referring to FIG. 10, when a resultant substrate 100 is at a side of an original substrate 10, and only one edge of the resultant substrate 100 needs to be polished (i.e., the edge at the cutting line), one edge polishing detection pattern 102 may be arranged. Referring to FIG. 11, when a resultant substrate 100 is at a side of an original substrate 10, and two edges of the resultant substrate 100 need to be polished (i.e., the two edges at the cutting lines), two edge polishing detection patterns 102 may be arranged. Referring to FIG. 12, when a resultant substrate 100 is at a center of an original substrate 10, and four edges of the resultant substrate 100 need to be polished, four edge polishing detection patterns 102 may be arranged.

That is, in some embodiments of the present disclosure, there is one edge polishing detection pattern.

In some embodiments of the present disclosure, there are two edge polishing detection patterns.

In some embodiments of the present disclosure, there are four edge polishing detection patterns.

Optionally, when there are four edge polishing detection patterns, two edge polishing detection patterns arranged respectively at two opposite edges of the substrate are identical, so that it is easy to determine whether attrition of the two opposite edges are the same.

In the above embodiments of the present disclosure, the edge polishing detection patterns at adjacent edges are not short circuited.

In the embodiments of the present disclosure, there may be many types of edge polishing detection patterns, the following descriptions are provided by way of examples.

The present disclosure will be described in detail in conjunction with drawings and embodiments. The following embodiments are of illustrative purposes, rather than to limit the scope of the present disclosure.

Figure 1:
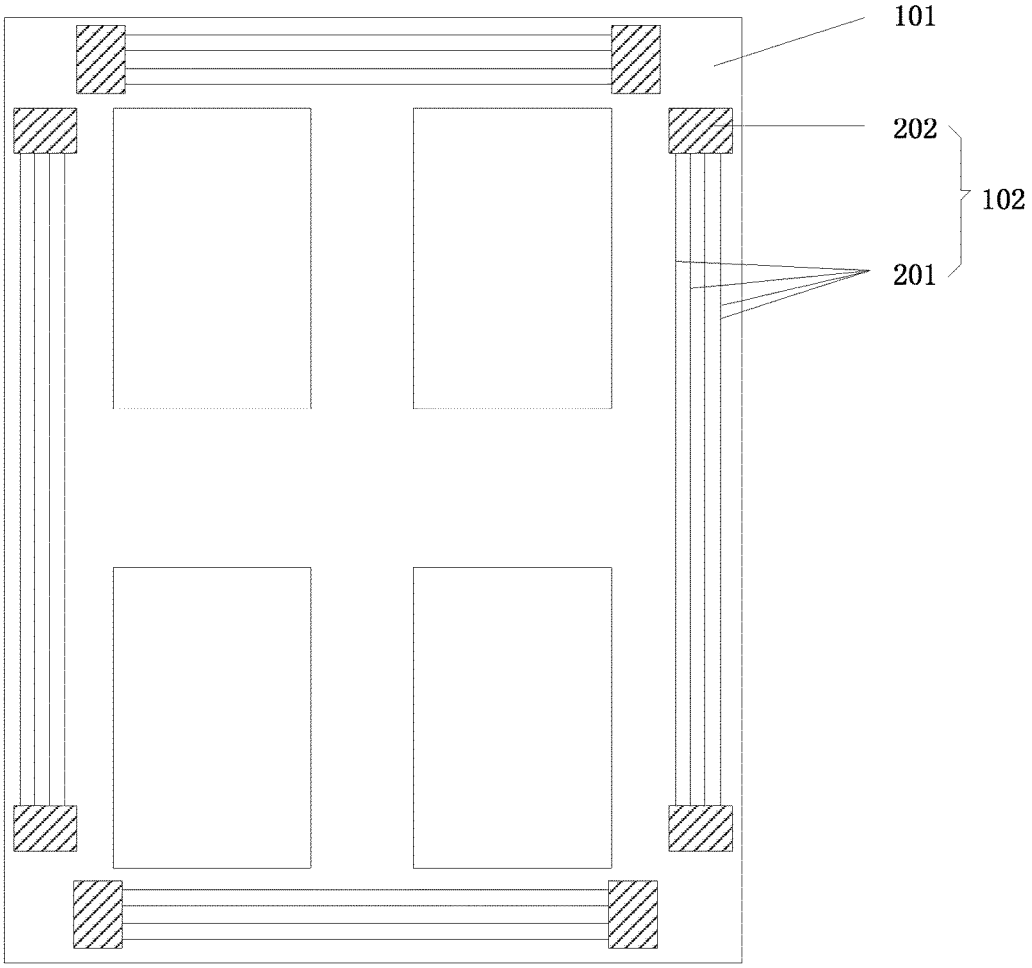
FIG. 1 is a schematic view of a substrate in some embodiments of the present disclosure.

Referring to FIG. 1, a schematic view of a substrate in some embodiments of the present disclosure is shown. The substrate includes a base substrate 101 and four edge polishing detection patterns 102 arranged on the base substrate 101, and the four edge polishing detection patterns 102 are arranged respectively at four edges of the base substrate 101 and made of a conductive material.

In some embodiments of the present disclosure, each edge polishing detection pattern 102 includes a plurality of resistive wires 201 arranged side by side, and the resistive wires 201 extend in a direction identical to an extension direction of the edge of the base substrate 101 where the resistive wires are located.

Optionally, the resistive wires 201 are of an identical width. Furthermore, every two adjacent resistive wires 201 are spaced at an identical interval.

According to the embodiments of the present disclosure, after the edge of the substrate is polished, a part of the resistive wires of each edge polishing detection pattern may be worn off since the edge polishing detection patterns are arranged at the edges of the substrate, so it is possible to determine the attrition degree of each edge polishing detection pattern by measuring the resistance of the remaining resistive wires which are not worn off so as to determine the attrition degree of the substrate.

Optionally, the edge polishing detection patterns 102 arranged respectively at two opposite edges of the base substrate are identical. That is, quantities of the resistive wires 201 of respective edge polishing detection patterns 102 arranged at two opposite edges of the base substrate are identical, the widths and the lengths thereof are identical, and the intervals between every two adjacent resistive wires 201 are identical.

In some embodiments of the present disclosure, each edge polishing detection pattern 102 includes four resistive wires 201. In some embodiments of the present disclosure, each edge polishing detection pattern 102 includes at least two resistive wires 201. Obviously, the more the edge polishing detection patterns 102, the more accurate the detection. In addition, in some embodiments of the present disclosure, the quantities of the resistive wires 201 of the edge polishing detection patterns 102 arranged at two adjacent edges may be different, and even the quantities of the resistive wires 201 of the edge polishing detection patterns 102 arranged at two opposite edges may be different.

In some embodiments of the present disclosure, the width of the resistive wire is 3 um, and the interval between adjacent resistive wires is 3 um, the maximum edge polishing distance is 150 um, thereby it is possible to form 17 resistive wires.

To facilitate the detection of the resistance of the resistive wires 201 of the edge polishing detection patterns 102, in some embodiments of the present disclosure, as shown in FIG. 1, two probe contacts 202 are arranged respectively at two ends of each edge polishing detection pattern 102, two ends of each resistive wire 201 of the edge polishing detection pattern 102 are connected to the two probe contacts 202 respectively, and the resistive wires 201 are connected in parallel via the two probe contacts 202.

When the edge of the base substrate 101 is polished, the quantity of the resistive wires 201 connected in parallel of each edge polishing detection pattern 102 may be changed, and then the resistance of each edge polishing detection pattern 102 may be changed accordingly, thereby reflecting the edge polishing degree of the corresponding edge.

Optionally, the resistive wires 201 are made of a material with a relatively large resistivity, e.g., a doped semiconductor material or a metallic material with a resistivity above a predetermined threshold. The doped semiconductor material may be P-type silicon, GaAs, GaN or ZnO, etc.

Optionally, the probe contacts 202 may be made of a material with a relatively small resistivity, e.g., a metallic material.

Figure 2:
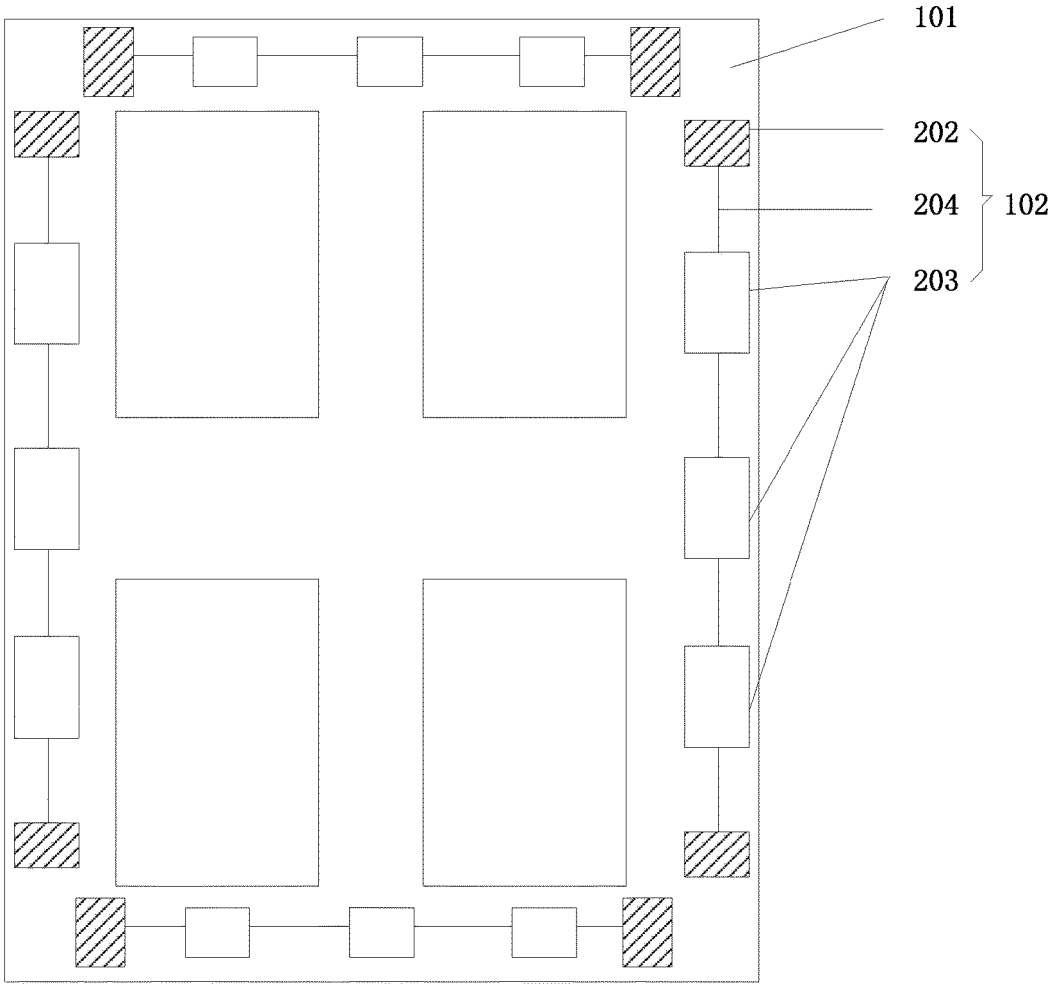
FIG. 2 is a schematic view of a substrate in some embodiments of the present disclosure.

Referring to FIG. 2, a schematic view of a substrate in some embodiments of the present disclosure is shown. The substrate includes a base substrate 101 and four edge polishing detection patterns 102 arranged on the base substrate 101, and the four edge polishing detection patterns 102 are arranged respectively at four edges of the base substrate 101 and made of a conductive material.

In some embodiments of the present disclosure, each edge polishing detection pattern 102 includes a plurality of resistive blocks 203 and a plurality of connecting wires 204 configured to connect the resistive blocks 203 in series.

Optionally, the resistive blocks 203 are of an identical size and aligned with each other along an extension direction of the edge of the base substrate 101 where the resistive blocks 203 are located.

According to the embodiments of the present disclosure, after the edge of the substrate is polished, the resistive blocks 203 of each edge polishing detection pattern 102 may be worn off partially since the edge polishing detection patterns 102 are arranged at the edges of the substrate, so it is possible to determine the attrition degree of each edge polishing detection pattern by measuring the resistance of the remaining resistive blocks which are not worn off so as to determine the attrition degree of the substrate.

Optionally, the edge polishing detection patterns 102 arranged respectively at two opposite edges of the base substrate are of an identical shape.

In some embodiments of the present disclosure, each edge polishing detection pattern 102 includes three resistive blocks 203. In some embodiments of the present disclosure, each edge polishing detection pattern 102 includes at least two resistive blocks 203. In addition, in some embodiments of the present disclosure, the quantities of the resistive blocks 203 of the edge polishing detection patterns 102 arranged at two adjacent edges may be different, and even the quantities of the resistive blocks 203 of the edge polishing detection patterns 102 arranged at two opposite edges may be different.

To facilitate the detection of the resistance of the edge polishing detection patterns 102, in some embodiments of the present disclosure, as shown in FIG. 2, two probe contacts 202 are arranged respectively at two ends of each edge polishing detection pattern 102, and the two probe contacts 202 are connected to the resistive blocks 203 in series via the connecting wires 204.

In the above two embodiments of the present disclosure, the width and length of the probe contact 202 may of the order of 100 micrometers, and the specific size of the probe contact may be determined based on the layout design of the substrate. Nonetheless, it is required to guarantee that the adjacent edge polishing detection patterns 102 are not short circuited.

The probe contacts 202 may be made of a metallic material. Because the resistance of the metallic material is relatively small, the edge polishing detection result may not be influenced even though the size of the probe contact 202 is changed.

Figure 3:
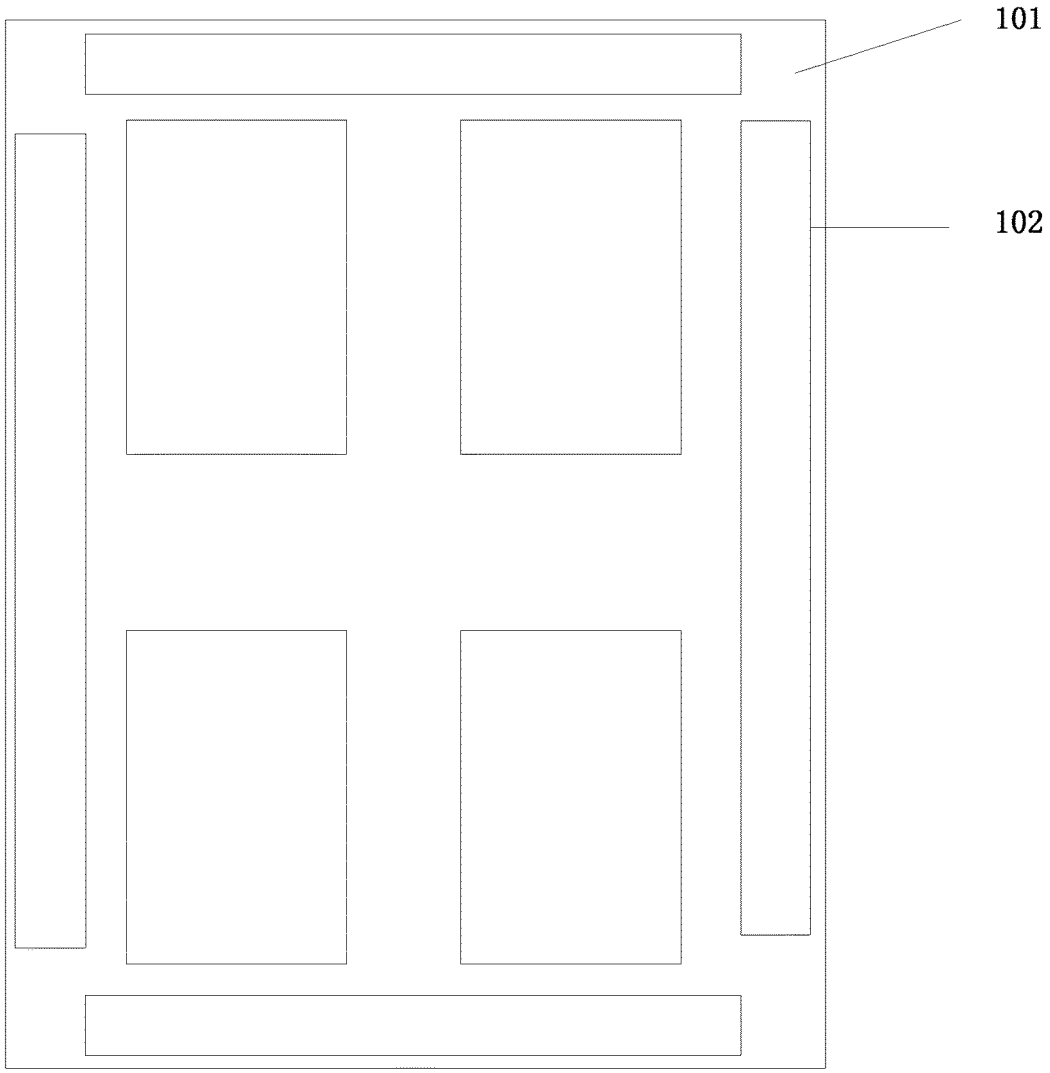
FIG. 3 is a schematic view of a substrate in some embodiments of the present disclosure.

Referring to FIG. 3, a schematic view of a substrate in some embodiments of the present disclosure is shown. The substrate includes a base substrate 101 and four edge polishing detection patterns 102 arranged on the base substrate 101, and the four edge polishing detection patterns 102 are arranged respectively at four edges of the base substrate 101 and made of a conductive material. In some embodiments of the present disclosure, the edge polishing detection pattern 102 is a strip-like conductive pattern, and an extension direction of a longer side of the strip-like conductive pattern is identical to an extension direction of the edge of the base substrate where the strip-like conductive pattern is located.

According to the embodiments of the present disclosure, after the edge of the substrate is polished, each strip-like edge polishing detection pattern 102 may be worn off partially since the edge polishing detection patterns 102 are arranged at the edges of the substrate, so it is possible to determine the attrition degree of each edge polishing detection pattern by measuring the resistance of the remaining edge polishing detection pattern which is not worn off so as to determine the attrition degree of the substrate.

The above embodiments are merely some embodiments of the edge polishing detection pattern. Certainly, there may be other types of edge polishing detection pattern. For example, the edge polishing detection patterns arranged at respective edges are different from each other, and the detailed description thereof is omitted herein.

In some embodiments of the present disclosure, the edge polishing detection patterns may be formed by a photo-etching process.

In the above embodiments, the base substrate may be a glass substrate, a ceramic substrate, or other types of base substrate.

Figure 9:
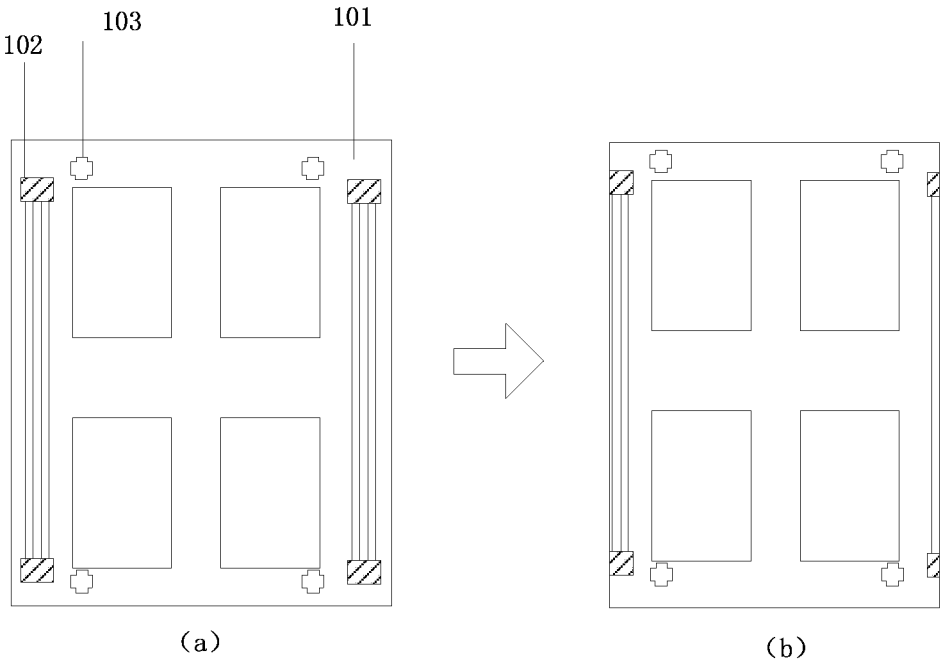
FIG. 9 shows a comparison of the substrate before and after the edge polishing process in some embodiments of the present disclosure.

Referring to FIG. 9, part (a) shows the base substrate 101 before the edge polishing process, and part (b) shows the base substrate 101 after the edge polishing process. It can be seen from FIG. 9, the polishing degree of the left and right edges of the base substrate 101 is different, and then a relative position between the left edge and a positioning mark 103 adjacent to the left edge is different from a relative position between the right edge and a positioning mark 103 adjacent to the right edge, therefore the subsequent alignment process may be difficult.

Figure 4:
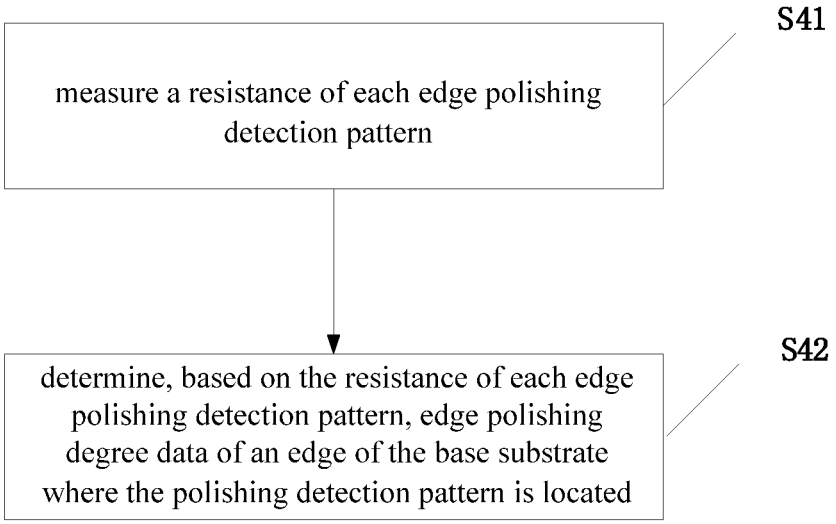
FIG. 4 is a flow chart of a substrate edge polishing detection method in some embodiments of the present disclosure.

Referring to FIG. 4, a substrate edge polishing detection method for the above substrate is further provided in some embodiments of the present disclosure, including:

Step 41: measure a resistance of each edge polishing detection pattern; and

Step 42: determine, based on the resistance of each edge polishing detection pattern, edge polishing degree data of an edge of the base substrate where each polishing detection pattern is located.

It is possible to determine an attrition degree of the substrate accurately by detecting the resistance of the edge polishing detection pattern, and thus the subsequent alignment process may be more accurate.

During the measurement of the resistance, it is possible to determine the edge polishing degree by measuring a resistance change (i.e., comparing the resistances before and after the edge polishing process). When identical edge polishing detection patterns are arranged at two opposite edges, it is further possible to compare the resistance changes of respective edge polishing detection patterns at the two opposite edges so as to determine the edge polishing degree.

Figure 5:
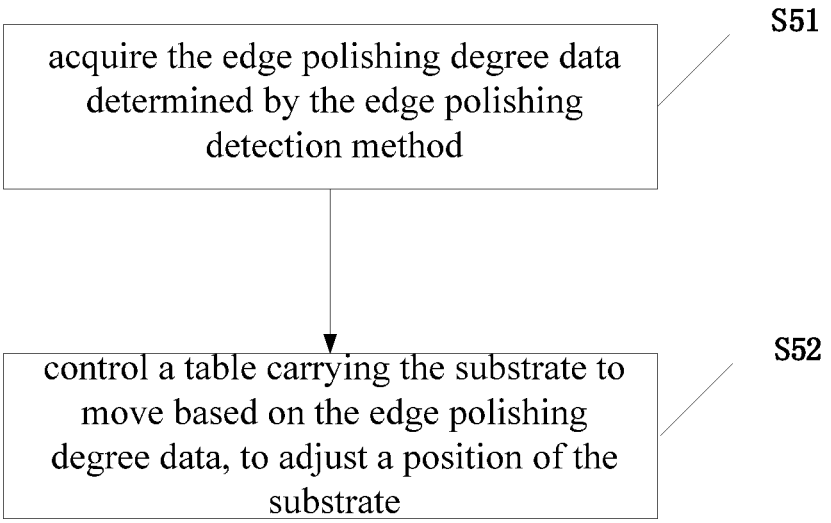
FIG. 5 is a flow chart of a substrate positioning method in some embodiments of the present disclosure.

Referring to FIG. 5, a substrate positioning method is further provided in some embodiments of the present disclosure, including:

Step 51: acquire the edge polishing degree data determined by the above edge polishing detection method; and Step 52: control a table carrying the substrate to move based on the edge polishing degree data, to adjust a position of the substrate.

Figure 6:
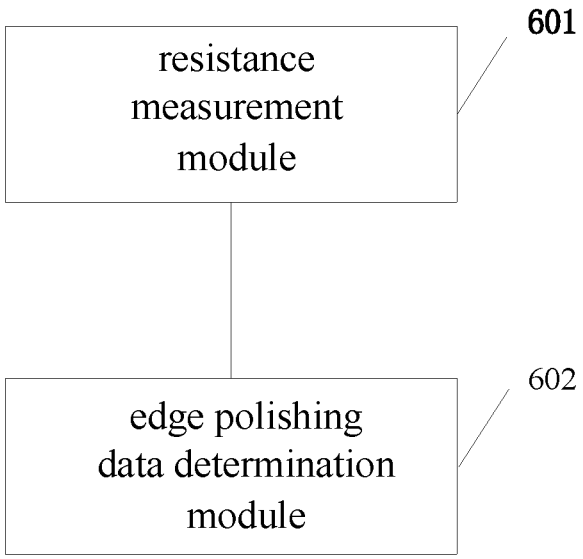
FIG. 6 is a schematic view of a substrate edge polishing detection device in some embodiments of the present disclosure.

Referring to FIG. 6, a substrate edge polishing detection device for the above substrate is further provided in some embodiments of the present disclosure, including:

a resistance measurement module 601, configured to measure a resistance of each edge polishing detection pattern; and an edge polishing data determination module 602, configured to determine, based on the resistance of each edge polishing detection pattern, edge polishing degree data of the edge of the base substrate where the polishing detection pattern is located.

Figure 7:
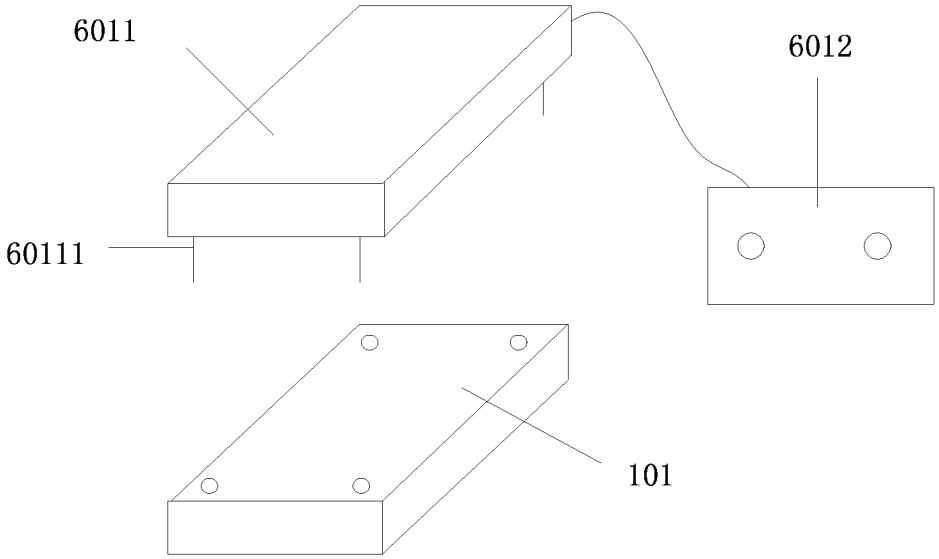
FIG. 7 is a schematic view of a resistance measurement module in some embodiments of the present disclosure.

Referring to FIG. 7, in some embodiments of the present disclosure, the resistance measurement module 601 includes:

a probe module 6011 including at least two sets of probes 60111, where two sets of probes 60111 are configured to connect to two ends of the edge polishing detection pattern 102 to energize the edge polishing detection pattern 102; and a microprocessor 6012, configured to acquire a current detection result of the energized edge polishing detection pattern 102 and determine the resistance of the edge polishing detection pattern 102 based on the current detection result.

Figure 8:
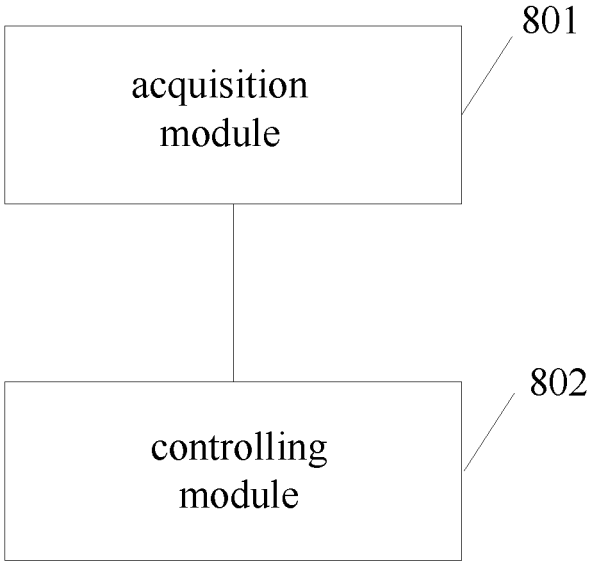
FIG. 8 is a schematic view of a substrate positioning device in some embodiments of the present disclosure.

Referring to FIG. 8, a substrate positioning device is further provided in some embodiments of the present disclosure, including:

an acquisition module 801, configured to receive the edge polishing degree data transmitted from the above substrate edge polishing detection device; and a controlling module 802, configured to control a table carrying the substrate to move based on the edge polishing degree data, to adjust a position of the substrate.

Figure 13:
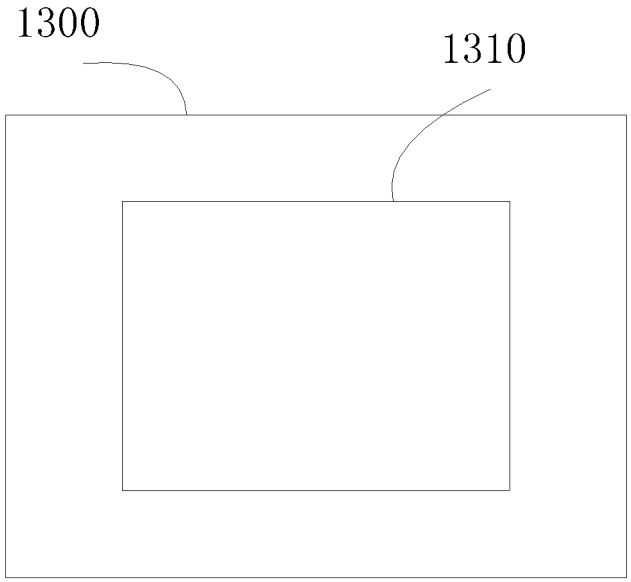
FIG. 13 is a schematic view of an exposure apparatus in some embodiments of the present disclosure.

An exposure apparatus is further provided in some embodiments of the present disclosure, including the above substrate positioning device and configured to position the substrate in an exposing process. As shown in FIG. 13, the exposure apparatus 1300 includes a substrate positioning device 1310.

Figure 14:
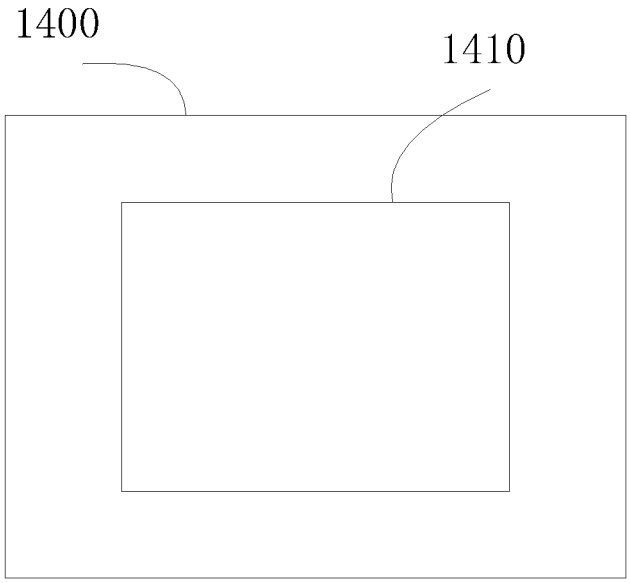
FIG. 14 is a schematic view of an evaporation device in some embodiments of the present disclosure.

An evaporation device is further provided in some embodiments of the present disclosure, including the above substrate positioning device and configured to position the substrate in an evaporation process. As shown in FIG. 14, the evaporation device 1400 includes a substrate positioning device 1410.

The above are some optional embodiments of the present disclosure. It should be noted that, a person skilled in the art may make further modifications and improvements without departing from the principle of the present disclosure, and these modifications and improvements shall also fall within the scope of the present disclosure.

What is claimed is:

1. A substrate, comprising a base substrate and at least one edge polishing detection pattern on the base substrate, wherein the at least one edge polishing detection pattern is provided at an edge of the base substrate and made of a conductive material, each edge polishing detection pattern comprises a plurality of resistive wires arranged side by side, and the plurality of resistive wires extends in a direction identical to an extension direction of the edge of the base substrate where the plurality of resistive wires is located;

wherein each edge polishing detection pattern comprises a plurality of resistive blocks and a plurality of connecting wires configured to connect the plurality of resistive blocks in series.

2. The substrate according to claim 1, wherein four edge polishing detection patterns are provided at four edges of the base substrate respectively.

3. The substrate according to claim 1, wherein the base substrate is rectangular.

4. The substrate according to claim 2, wherein the edge polishing detection patterns at two opposite edges of the base substrate respectively are identical.

5. The substrate according to claim 1, wherein the plurality of resistive wires is of an identical width.

6. The substrate according to claim 1, wherein every two adjacent resistive wires of each edge polishing detection pattern are spaced at an identical interval.

7. The substrate according to claim 1, wherein two probe contacts are provided at two ends of each edge polishing detection pattern respectively, two ends of each resistive wire of the edge polishing detection pattern are connected to the two probe contacts respectively, and the plurality of resistive wires of the edge polishing detection pattern is connected in parallel via the two probe contacts.

8. The substrate according to claim 1, wherein the plurality of resistive wires is made of a doped semiconductor material or a metallic material.

9. The substrate according to claim 8, wherein the doped semiconductor material comprises at least one of: P-type silicon, GaAs, GaN and ZnO.

10. The substrate according to claim 1, wherein the plurality of resistive blocks is of an identical size and aligned with each other along an extension direction of the edge of the base substrate where the plurality of resistive blocks is located.

11. The substrate according to claim 1, wherein two probe contacts are provided at two ends of each edge polishing detection pattern respectively, and the two probe contacts are connected to the resistive blocks in series via the connecting wires.

12. The substrate according to claim 1, wherein the edge polishing detection pattern is stripe-like, and an extension direction of a longer side of the stripe-like conductive pattern is identical to an extension direction of the edge of the base substrate where the stripe-like conductive pattern is located.

13. A substrate edge polishing detection method for the substrate according to claim 1, comprising:

measuring a resistance of each edge polishing detection pattern; and determining, based on the resistance of each edge polishing detection pattern, edge polishing degree data of an edge of the base substrate where the polishing detection pattern is located.

14. A substrate positioning method, comprising:

acquiring the edge polishing degree data determined by the edge polishing detection method according to claim 13; and controlling a table carrying the substrate to move based on the edge polishing degree data, to adjust a position of the substrate.

15. A substrate edge polishing detection device for the substrate according to claim 1, comprising:

a resistance measurement module, configured to measure a resistance of each edge polishing detection pattern; and an edge polishing data determination module, configured to determine, based on the resistance of each edge polishing detection pattern, edge polishing degree data of the edge of the base substrate where the polishing detection pattern is located.

16. The device according to claim 15, wherein the resistance measurement module comprises:

a probe module comprising at least two sets of probes, wherein two sets of probes of the at least two sets of probes are configured to be connected to two ends of the edge polishing detection pattern to energize the edge polishing detection pattern; and a microprocessor, configured to acquire a current detection result of the energized edge polishing detection pattern and determine the resistance of the edge polishing detection pattern based on the current detection result.

17. A substrate positioning device, comprising:

an acquisition module, configured to receive the edge polishing degree data transmitted from the substrate edge polishing detection device according to claim 15; and a controlling module, configured to control a table carrying the substrate to move based on the edge polishing degree data, to adjust a position of the substrate.

18. An exposure apparatus comprising the substrate positioning device according to claim 17.

19. An evaporation device comprising the substrate positioning device according to claim 17.

* * * * *